US010024052B2

(12) United States Patent
Marsh

(10) Patent No.: US 10,024,052 B2
(45) Date of Patent: Jul. 17, 2018

(54) MECHANICALLY SECURED BLOCK ASSEMBLY SYSTEMS

(71) Applicant: 3B Construction Solution Inc., Anderson, IN (US)

(72) Inventor: Roger F. Marsh, Anderson, IN (US)

(73) Assignee: 3B Construction Solutions, Inc., Anderson, IN (US)

( * ) Notice: Subject to any disclaimer, the term of this patent is extended or adjusted under 35 U.S.C. 154(b) by 0 days.

(21) Appl. No.: 15/142,422

(22) Filed: Apr. 29, 2016

(65) Prior Publication Data

US 2016/0319540 A1 Nov. 3, 2016

Related U.S. Application Data

(63) Continuation of application No. 14/551,665, filed on Nov. 24, 2014, now Pat. No. 9,328,501, which is a (Continued)

(51) Int. Cl.
*E04C 5/08* (2006.01)
*E04B 2/16* (2006.01)
(Continued)

(52) U.S. Cl.
CPC ..... *E04B 2/16* (2013.01); *E04B 1/043* (2013.01); *E04B 1/5825* (2013.01); *E04B 2/18* (2013.01);
(Continued)

(58) Field of Classification Search
CPC ..... E04B 1/043; E04B 1/5825; E04B 2/18; E04B 5/08; E04B 7/00; E04B 2001/5887; E04B 2001/5893; E04B 2002/0247; E04B 2002/0297; E04C 1/00; E04C 5/06; E04C 5/162
(Continued)

(56) References Cited

U.S. PATENT DOCUMENTS 1,496,754 A 6/1924 Eaves
6,098,357 A * 8/2000 Franklin ..... E04B 2/14 52/223.7
(Continued)

*Primary Examiner* — Brian D Mattei
(74) *Attorney, Agent, or Firm* — C. John Brannon; Kelly J. Smith; Brannon Sowers & Cracraft PC

(57) ABSTRACT

A method for building a mechanical secured block structure, including placing a footer block on a desired surface, inserting two respective starter bar nuts into the footer block, inverting the footer block, placing a first concrete masonry unit over respective first and second anchor bars, aligning the first concrete masonry unit with the footer block, placing second and third footer blocks adjacent the first footer block, placing a second concrete masonry unit adjacent the first concrete masonry unit, positioning each respective concrete masonry unit to equally straddle two adjacent footer blocks, positioning respective anchor bars atop respective concrete masonry units, and bolting respective concrete masonry units to respective footer blocks to interconnect the two respective concrete masonry units and the three respective footer blocks to define a contiguous wall. Each respective masonry unit and each respective footer block are post tensioned to be under compression.

13 Claims, 16 Drawing Sheets

Related U.S. Application Data continuation of application No. 14/098,440, filed on Dec. 5, 2013, now Pat. No. 8,893,447, said application No. 14/551,665 is a continuation-in-part of application No. 11/353,253, filed on Feb. 13, 2006, now Pat. No. 9,206,597.

(60) Provisional application No. 61/733,536, filed on Dec. 5, 2012.

(51) Int. Cl.

| | |
|---|---|
| ***E04C 5/12*** | (2006.01) |
| ***E04B 1/04*** | (2006.01) |
| ***E04B 1/58*** | (2006.01) |
| ***E04B 2/18*** | (2006.01) |
| ***E04B 5/08*** | (2006.01) |
| ***E04B 7/00*** | (2006.01) |
| ***E04C 1/00*** | (2006.01) |
| ***E04C 5/06*** | (2006.01) |
| ***E04C 5/16*** | (2006.01) |
| ***E04B 2/26*** | (2006.01) |
| *E04C 3/22* | (2006.01) |
| *E04C 3/02* | (2006.01) |
| *E04B 2/02* | (2006.01) |

(52) U.S. Cl.

CPC ..... *E04B 2/26* (2013.01); *E04B 5/08* (2013.01); *E04B 7/00* (2013.01); *E04C 1/00* (2013.01); *E04C 5/06* (2013.01); *E04C 5/08* (2013.01); *E04C 5/125* (2013.01); *E04C 5/162* (2013.01); *E04B 2001/5887* (2013.01); *E04B 2001/5893* (2013.01); *E04B 2002/0202* (2013.01); *E04B 2002/0247* (2013.01); *E04B 2002/0254* (2013.01); *E04B 2002/0297* (2013.01); *E04C 3/22* (2013.01); *E04C 2003/023* (2013.01)

(58) Field of Classification Search

USPC ..... 52/223.7, 223.13, 223.5, 253, 285.2, 52/293.3, 293.2, 431, 600

See application file for complete search history.

(56) References Cited

U.S. PATENT DOCUMENTS

| | | | | |
|---|---|---|---|---|
| 6,138,426 | A | 10/2000 | Mork et al. | |
| 6,178,714 | B1 * | 1/2001 | Carney, Jr. | E04B 1/34315 52/223.7 |
| 6,513,296 | B1 | 2/2003 | Baden | |
| 7,461,490 | B2 * | 12/2008 | Toledo | E04B 2/14 52/293.2 |
| 2004/0020145 | A1 * | 2/2004 | Matsufuji | E04B 2/42 52/223.7 |
| 2006/0201082 | A1 * | 9/2006 | Hammer | E04C 1/395 52/223.5 |
| 2007/0107333 | A1 | 5/2007 | Marsh et al. | |
| 2008/0256894 | A1 | 10/2008 | Marsh et al. | |
| 2009/0188186 | A1 | 7/2009 | Ebanks | |
| 2009/0313923 | A1 | 12/2009 | Bucheger | |
| 2011/0013991 | A1 | 1/2011 | Watson et al. | |

* cited by examiner

Section A-A

Section B-B

133A

180
C
X
Y

BC13

C
X
Y
180

133

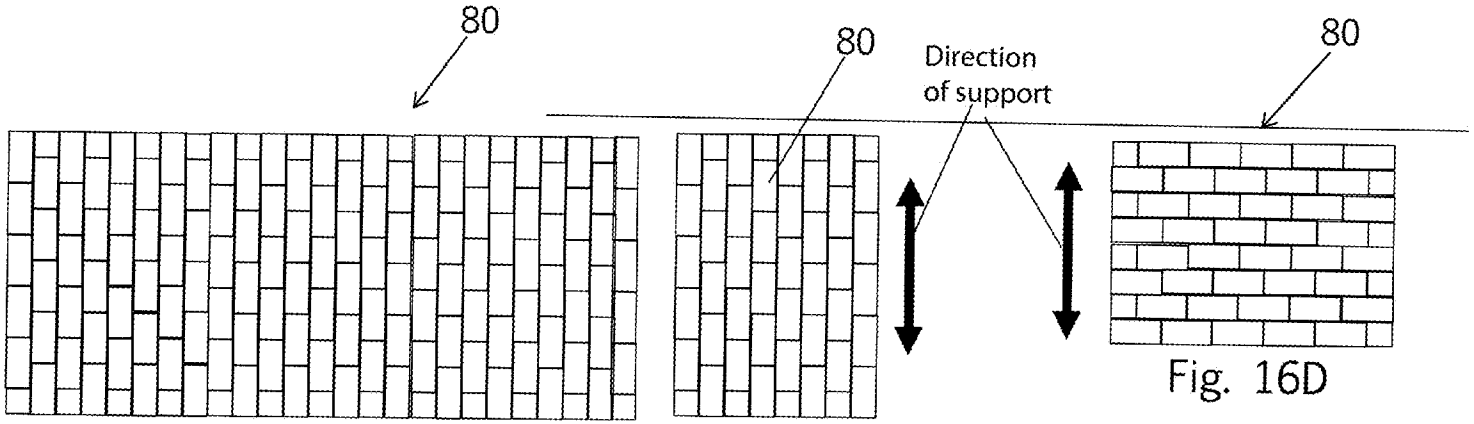
Fig. 16A
Fig. 16B
Fig. 16D
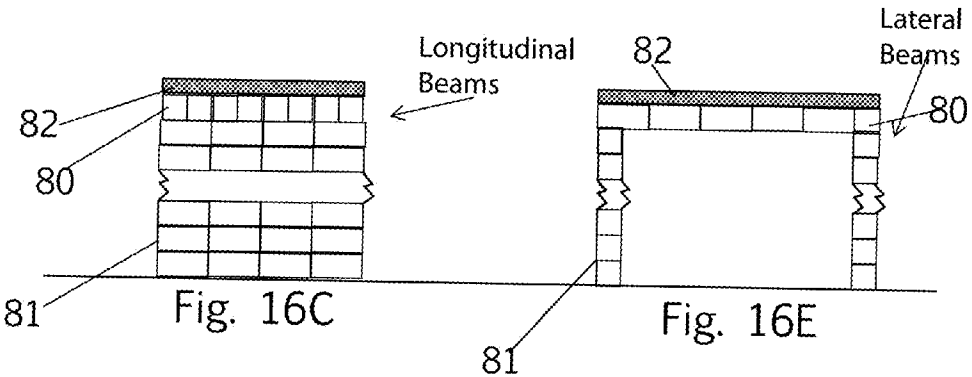
Fig. 16C
Fig. 16E

MECHANICALLY SECURED BLOCK ASSEMBLY SYSTEMS

CROSS-REFERENCE TO RELATED APPLICATIONS

This application is a continuation of and claims priority to co-pending U.S. patent application Ser. No. 14/551,665, filed on Nov. 24, 2014, which was a continuation-in-part of then co-pending U.S. patent application Ser. No. 11/353,253, filed on Feb. 13, 2006, and was also a continuation of, then co-pending U.S. patent application Ser. No. 14/098,440, filed on Dec. 5, 2013, which claimed the benefit of then U.S. Provisional Patent Application Ser. No. 61/733,536 filed Dec. 5, 2012.

FIELD OF NOVEL TECHNOLOGY

Embodiments of the present novel technology relate generally to construction materials, and, more particularly, to unitized post tension systems and methods for concrete masonry structures.

BACKGROUND

Existing unitized post tension systems for concrete masonry structures have until now required special other construction to address larger wall widths over approximately eight inches, to address horizontal decks and to address structural grade beams. The existing taught systems did not easily accommodate those needs in a unitized post tension system.

The prior art unitized post tension systems address methods and systems to rapidly build structures, including walls with for use as flat deck, wider wall systems and large grade beams. Recent unitized post tension systems facilitated improvements to traditional construction systems and their limitations. The recent systems do not require special skills to construct; does not need water and power; do not require elaborate bracing; provides immediate occupancy or use; needs no curing time; and are re-useable if desired since it is not destroyed when disassembled and moved. While the recent systems are improvements to decrease the time to build or rebuild areas with minimal skilled labor and provide a far superior and more consistent strength structure than the traditional mortar constructed structure, these systems still have room for improved devices and configurations to meet known shortcomings. The problems and limitations of the prior art unitized post tension systems are addressed generally for the use as flat deck, wider wall systems and large grade beams. In the building industry, the masonry, precast concrete and poured in place, tilt-up wall systems often accompany a building type—industrial, commercial, and hi-rise residential—where floor and roof decks are utilized. For example, motel and hotels and office buildings, strip malls and the like will incorporate precast decks or poured in place steel sheet metal and concrete to provide floors and roof decks. Therefore an alternative flat decking means from the unitized post tension system is desirable.

The unitized post tension system has also found acceptance in the southern building needs in Mississippi and Louisiana. In those locations, the rapid build system afforded by unitized post tension systems still had restrictions with the need for grade beams to be used in the quasi-marsh areas in cooperation with posts or pilings. Here the spans were of such lengths that some consideration for higher tension strength in the grade beams presented some challenges to the unitized post tension system. Therefore a better adapted and improved grade beam made of unitized post tension components with added features and capabilities is desirable.

The final desired improvement to unitized post tension systems is not an intuitively obvious need. In the concrete masonry unit (CMU) building systems, the approximately eight inch wide block is the main component. However, over the years, the need for ten inch, twelve inch and larger widths became evident. These were addressed by the industry to provide wide base walls. However, these wider block came at a price: they required all new, wider molds to produce; they were much heavier and usually required two people to lift and transport, and they often needed additional tooling and accessories to match the wider widths. Therefore, it is desirable to build wider, higher capacity wall systems from the unitized post tension components. The new system that addresses this will save the cost of molds, added labor and employee fatigue, and added costs for the wider blocks. However, the new use of the unitized post tension components would need to be as strong or even stronger than the CMU counterparts. These problems or limitations of the desires for the use as flat deck, wider wall systems and large grade beams are described below.

Historically, no known devices have attempted to address the problem as stated. The building industry has made little progress for a unitized, post tension system so improvements to the recent unitized post tension systems have not yet been attractive to promotion of the technology. Even so, blocks have required very special and often complex configurations to even handle rods and plates and then they have taught only limit rods in special blocks. One such device is an instant levy block system. This is a complex, specially made block for constructing a levy, comprising a plurality of blocks, a plurality of connecting pegs, and a plurality of stakes. Each part is uniquely designed and made whereas the novel technology uses a commonly made block designed for the common bars and bolts. Another block device is a masonry block with an embedded plate. The concrete masonry block has an external plate or plates that are anchored through the concrete masonry block. The external plates are cast into the concrete masonry block in the mold during casting. These plates and metal pieces are not taught as being part of a post tensioning system now shown cast within the hollow cavities as addressed by the improved novel technology.

Another device for construction is a modular pre-cast construction block system with a wall subsystem and a foundation subsystem. The wall subsystem has a number of wall units having cavities and pre-stressed tension cables are cast therein the cavity. This teaches precast walls and pass through cable which are specially made, require water, and are not readily re-useable like the novel technology. A somewhat re-useable system includes long rods that extend through apertures in the specially cast block and the precast structures. No description of pre or post tensioning is taught or claimed. The configuration of special length rods, special blocks, special plates and a complex system that requires powered equipment to construct is unlike the novel technology.

One known mortarless wall structure comprises columns of preformed, lightweight, stacked blocks, with the columns of blocks connected to each other by elongated, vertically oriented, support beams. Preferably, the wall structure is operatively connected to a structure by one or more brackets. The beams and blocks are special configuration, not readily available and with limited uses. These are complex and do not anticipate the novel technology.

An interlocking, mortar less system is accomplished by some other devices. However, none of them are found to show a structural unitized post tensioning system as described for the novel technology in the materials below. An example of one such interlocking device is a block of concrete or the like for use in constructing a mortar less wall. The device provided includes a spaced parallel pair of upright sidewalls having flat bottoms and tops and bearing integral block interlocking connectors and various configurations on their opposite ends. The sidewalls are integrally connected by means of these configurations. This is not the configuration taught by the novel technology. Another motarless system is a set of superimposed building blocks with vertically spaced flat bars inter-fitted with the blocks and studs inserted through one bar and then threaded into engagement with bars of lower blocks.

None of the prior art found with a rigorous search teaches all the features and capabilities of the novel technology. As far as known, there are no systems at the present time which fully meet the need for a unitized, post-tensioned masonry block structure with the described shortfalls which are now resolved by the present novel technology. It is believed that this system is made with component parts, is built with simple tools, and provides a much stronger structure than prior art devices and systems.

SUMMARY

This technology relates to new modifications and uses of a bolt and bar, mechanically secured block system. New use devices include multi width walls, horizontal decks and structural beams such as grade beams. Taught here are the ways to significantly improve and expand the use of mechanically secured block far beyond anticipation of current/prior art devices nor obvious to one skilled in the art of block construction—mechanical or otherwise.

One preferred embodiment of the uses for the novel technology are shown in the drawings and further described below. The embodiment is a mechanical secured block building system for constructing structures with concrete masonry units, the system comprising: (a) a masonry block unit with a height and width essentially one-half the length of the unit, with multiple cavities through the block and with a recessed channel; (b) an anchor bar with a plurality of threaded and non-threaded apertures in a special configuration to match the cavities in the block unit and able to lay in the recessed channel of the block; and (c) a fastener wherein the mechanical secured block building system can be assembled in unique ways due to a cube effect of the masonry block to construct multiple width walls, grade beams, and horizontal decks. An alternative embodiment includes the mechanical secured block building system is further comprised of: (d) a footer block and (e) a footer plate.

BRIEF DESCRIPTION OF THE DRAWINGS

The accompanying drawings, which are incorporated in and constitute a part of this specification, illustrate embodiments of the novel technology. The drawings together with the summary description given above and a detailed description given below serve to explain the principles of the construction system. It is understood, however, that the novel technology for block construction systems is not limited to only the precise arrangements and instrumentalities shown. While multiple embodiments are disclosed, still other embodiments of the present novel technology will become apparent to those skilled in the art from the following detailed description, which shows and describes illustrative embodiments of the novel technology. Accordingly, the drawings and detailed description are to be regarded as illustrative in nature and not restrictive.

FIG. 16A is a first elevation of the horizontal beam/slabs for MSB systems.

FIG. 16B is a second elevation of the horizontal beam/slabs for MSB systems.

FIG. 16C is a third partial elevation of the horizontal beam/slabs for MSB systems.

FIG. 16D is a fourth elevation of the horizontal beam/slabs for MSB systems.

FIG. 16E is a fifth partial elevation of the horizontal beam/slabs for MSB systems.

Figure 1C:
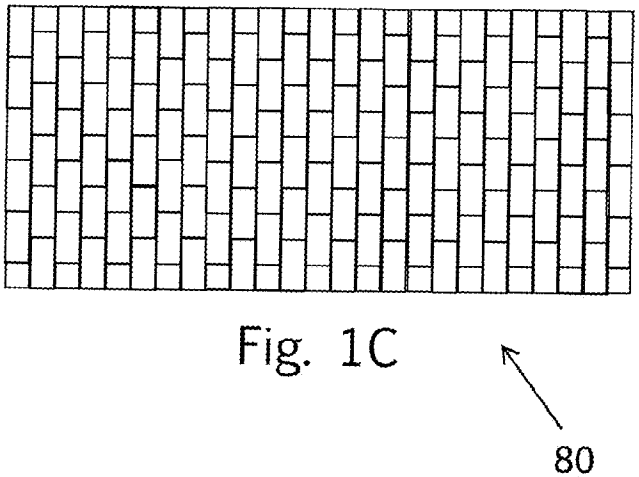
FIG. 1C is a third elevation view of general mechanical block special enhancements, of multi walls, grade beams and horizontal beam/slabs.

While the novel technology is amenable to various modifications and alternative forms, specific embodiments have been shown by way of example in the drawings and are described in detail below. The intention, however, is not to limit the novel technology to the particular embodiments described. On the contrary, the novel technology is intended to cover all modifications, equivalents, and alternatives falling within the scope of the novel technology as defined by the appended claims.

DETAILED DESCRIPTION

The present novel technology relates to new use devices for Mechanically Secured Block (MSB) Assembly Systems. Embodiments of the present novel technology relate generally to systems and methods for concrete masonry structures, and more particularly to unitized post tension systems and methods for concrete masonry structures. The present novel technology relates generally to all types of general construction where a common mortar and hollow block or brick combination is utilized and relates to other construction means, such as reinforced concrete, for structures as well. The embodiments of the novel technology are shown in the accompanying sketches and described below.

There is shown in FIGS. 1-16E a complete description and operative embodiment of the novel technology. In the drawings and illustrations, FIGS. 1-16E demonstrate the general configuration and use of this product/system. The various example uses are in the operation and use section, below.

The accompanying drawings, which are incorporated in and constitute a part of this specification, illustrate an embodiment of the novel technology that are preferred. The drawings together with the summary description given above and a detailed description given below serve to explain the principles of the construction system and devices. It is understood, however, that the novel technology are not limited to only the precise arrangements and instrumentalities shown. Other examples of similar construction systems within this same scope are still understood by one skilled in the art of construction systems, directly or indirectly associated with block systems, to be within the scope and spirit shown here.

Some (non-limiting) examples of the new device uses of the system are: A. Permits a way to create long beams, especially grade beams;

B. Provides cubing of the piers in the building systems with block width=block height=½ block length;

C. Establishes a manner to provide multiple width walls that are integrally tied together for greater strength and durability;

D. Reduces the cost of wider walls by using one common unit (approximately 16×8×8 inch) rather than 10 or 12 inch widths. This reduces of molds, accessories and labor to handle larger block units;

E. Allows for horizontal decks, floors and cantilevered building assemblies; and F. Capitalizes on the new mechanical block assembly systems and removes the need to use other construction methods for decks, grade beams and wider wall assemblies.

One embodiment is a mechanical secured block building system for constructing structures with concrete masonry units, the system comprising: (a) a masonry unit, the masonry unit being made of concrete and comprising: a masonry longitudinal length, a masonry width measured perpendicularly to the masonry longitudinal length, wherein the masonry width which is essentially one half the longitudinal length and which is substantially uniform along the masonry longitudinal length, a masonry top surface, the masonry top surface being substantially planar, a masonry bottom surface, the masonry bottom surface being substantially planar, a masonry height which is essentially one half the longitudinal length and which is measured between the masonry top and masonry bottom surfaces, the masonry height being substantially uniform along the masonry longitudinal length, a first through-cavity formed through the masonry unit from the top surface to the bottom surface, a second through-cavity formed through the masonry unit from the top surface to the bottom surface, a third through-cavity formed through the masonry unit from the top surface to the bottom surface, and an anchor bar channel recessed formed in the masonry top surface and oriented substantially along the masonry longitudinal length; (b) an anchor bar, the anchor bar comprising: (i) a first set of apertures, the first set of apertures comprising a first non-threaded aperture and a first threaded aperture, wherein the first non-threaded aperture and the first threaded aperture are located in first and second diagonally opposing quadrants of a coordinate system defined by a longitudinal centerline of the anchor bar and a line that is perpendicular to the longitudinal centerline; and (ii) a second set of apertures neighboring the first set of apertures, the second set of apertures comprising a second non-threaded aperture that is substantially the same as the first non-threaded aperture, and a second threaded aperture that is substantially the same as the first threaded aperture, wherein the second non-threaded aperture and the second threaded aperture are located in third and fourth diagonally opposing quadrants of the coordinate system but spaced longitudinally from the first set of apertures wherein the first set of apertures is aligned with the first through-cavity and the second set of apertures is aligned with the third through-cavity when the anchor bar is placed into the anchor bar recessed channel of the masonry unit and wherein a width of the anchor bar is smaller than a width of the recessed channel of the masonry unit; and (c) a fastener, the fastener comprising: (i) a first fastener end and a second fastener end, (ii) a head portion at the first fastener end, (iii) a stem portion rigidly affixed to the head portion, the stem portion comprising a threaded portion at the second fastener end wherein the head portion does not fit through the first non-threaded aperture, wherein the stem portion slides freely through the first non-threaded aperture, and wherein the threaded portion is configured to thread ably engage the first threaded aperture wherein the mechanical secured block building system can be assembled in unique ways due to a cube effect of the masonry block to construct multiple width walls, grade beams, and horizontal decks.

An alternative embodiment includes the previously described mechanical secured block building system further comprised of: (d) a footer block, the footer block being made of concrete and comprising: a footer longitudinal length substantially the same as the masonry longitudinal length; a footer width measured perpendicularly to the footer longitudinal length and essentially one half the longitudinal length, wherein the footer width is substantially uniform along the footer longitudinal length, a footer top surface, the footer top surface being substantially planar, a footer bottom surface, the footer bottom surface being substantially planar, a footer height measured between the footer top and footer bottom surfaces, the footer height being substantially uniform along the footer longitudinal length, a footer recess formed on the footer bottom surface, and a footer through-hole formed from the footer top surface to the footer recess; and (e) a footer plate, the footer plate comprising: a footer threaded aperture, the footer threaded aperture configured to threadably engage the threaded portion of a lower most fastener, wherein the footer plate fits within the footer recess such that, when received by the footer recess, the footer plate does not protrude below the second bottom surface and the footer plate is substantially prevented from rotating within the footer recess.

Figure 1B:
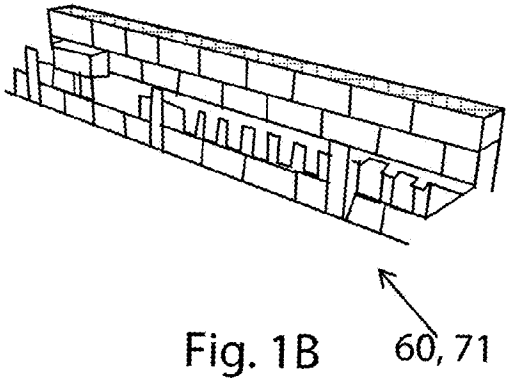
FIG. 1B is a second perspective view of general mechanical block special enhancements, of multi walls, grade beams and horizontal beam/slabs.
Figure 1A:
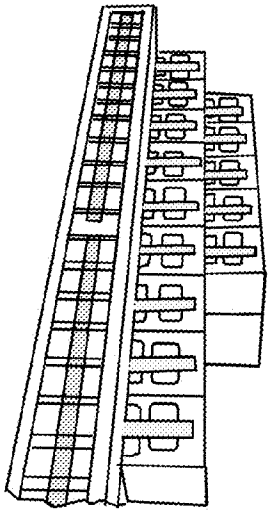
FIG. 1A is a first perspective view of general mechanical block special enhancements, of multi walls, grade beams and horizontal beam/slabs.

FIGS. 1 A through 1C are sketches of the general mechanical block special enhancements, of multi walls 30, grade beams 60, 71 and horizontal beam/slabs 80. The components of the sketches are described in the following paragraphs.

Figure 2A:
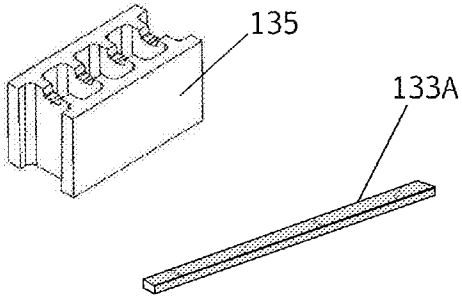
FIG. 2A is a first perspective view of mechanical systems for unitized post tensioning block, bar and fastener components plus a method to assemble a typical wall.
Figure 2B:
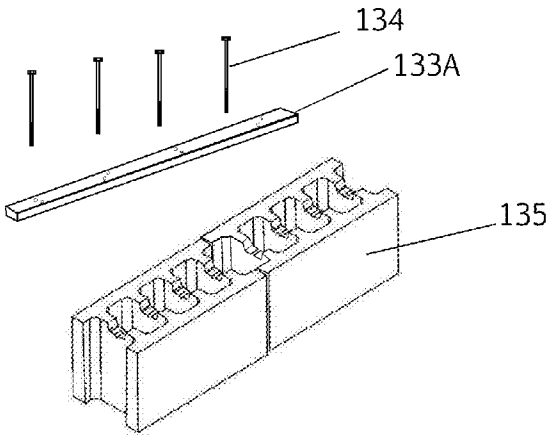
FIG. 2B is a second perspective view of mechanical systems for unitized post tensioning block, bar and fastener components plus a method to assemble a typical wall.
Figure 2C:
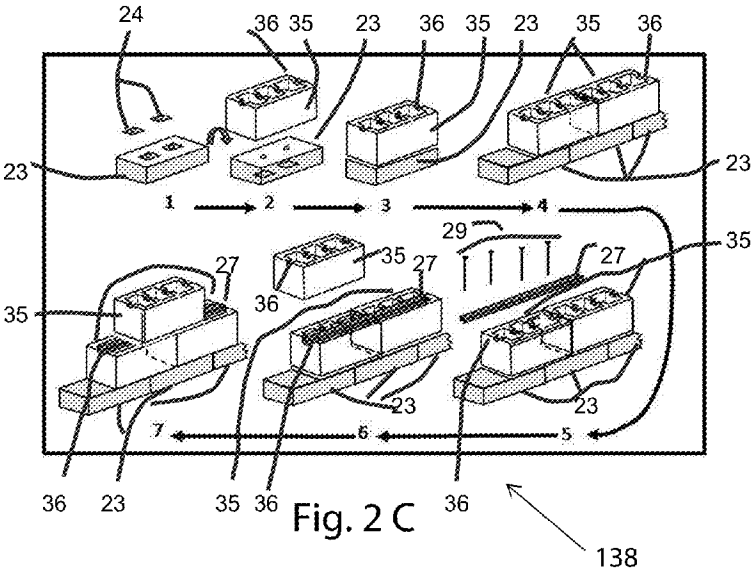
FIG. 2C is a third schematic perspective view of mechanical systems for unitized post tensioning block, bar and fastener components plus a method to assemble a typical wall.
Figure 3D:
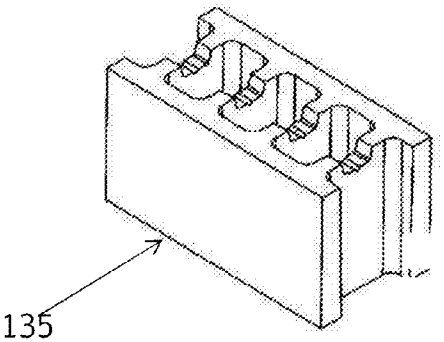
FIG. 3D is a fourth perspective view of a mechanical system for unitized post tensioning.
Figure 3A:
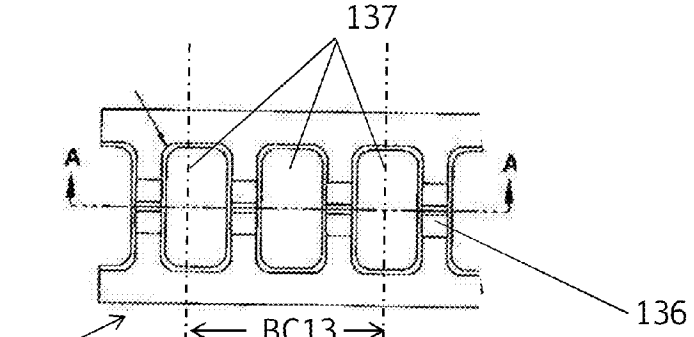
FIG. 3A is a first partial top plan view of a mechanical system for unitized post tensioning.
Figure 3B:
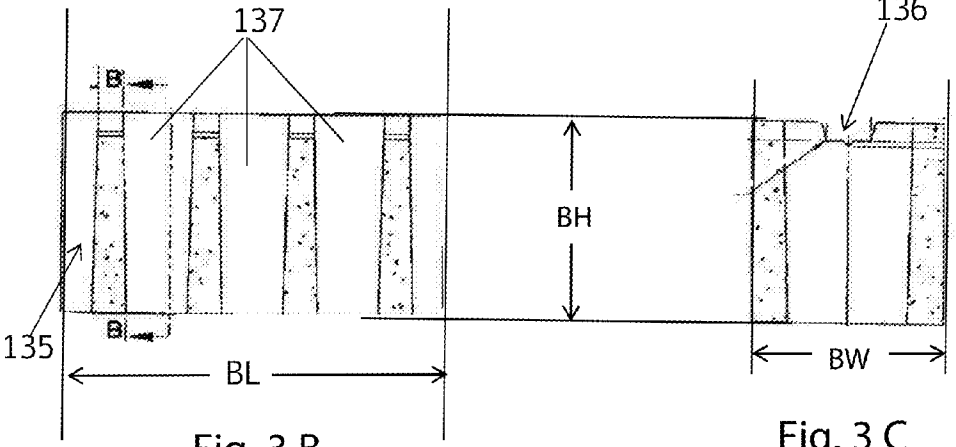
FIG. 3B is a second side plan view of a mechanical system for unitized post tensioning.
Figure 3C:
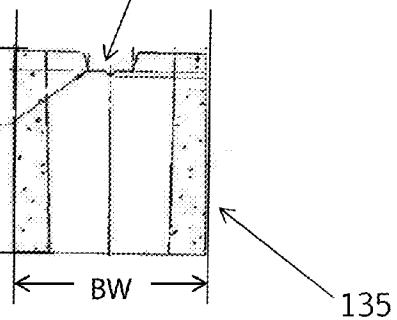
FIG. 3C is a third end plan view of a mechanical system for unitized post tensioning.
Figures 4A, 4B, 4C, 4D:
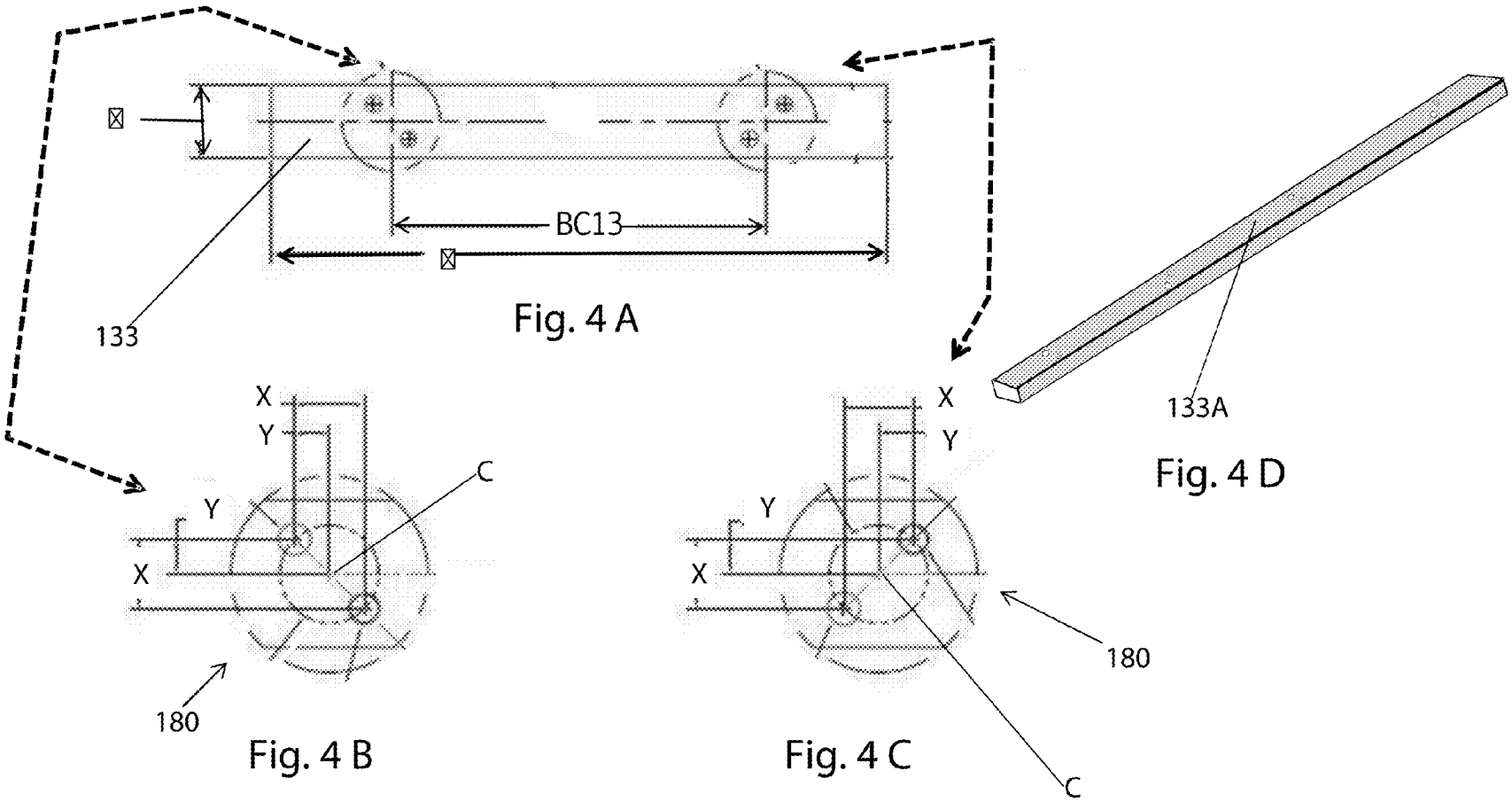
FIG. 4A is a first plan view of the bars for the mechanical systems for unitized post tensioning building systems.
FIG. 4B is a second end view of the bars for the mechanical systems for unitized post tensioning building systems.
FIG. 4C is a third end view of the bars for the mechanical systems for unitized post tensioning building systems.
FIG. 4D is a fourth perspective view of the bars for the mechanical systems for unitized post tensioning building systems.

FIGS. 2A through 2C are sketches of the mechanical systems for unitized post tensioning block 135, longer bar 133A and fastener 134 components plus a method 138 to assemble a typical wall. Assembly Process for FIG. 2C:

| Step | Description |
|---|---|
| 1 | Place footer block 23 and insert two starter bar nuts 24, then invert the footer block 23 |
| 2 | Place CMU 35, which may be similar to block 135, over starter anchor bars or the starter bar nut 24 |
| 3 | Align CMU 35 with footer block 23 |
| 4 | Place two additional footer blocks 23 and an additional CMU 35. Slide the CMUs 35 so they split, or straddle, the footer blocks 23 (i.e. - half a CMU 35 on each of two footers 23) |
| 5 | Place an anchor bar 27, which may be similar to bar 133A, and tendon/through bolts 29, which may be similar to fasteners 134, onto the CMUs 35 and tighten the two tendon/through bolts 29 into the threaded apertures in the lowermost starter anchor bars, which may be similar to anchor bars 27, or starter bar nuts 24 by means of a wrench or equal which secure the anchor bar 27 in a tensioned condition with the CMU 35 |
| 6 | Place an additional CMU 35 next to or on top of the first two CMUs 35 |
| 7 | Place the second CMU 35 over an anchor bar 27 or starter bar, nuts 24; then place one or more anchor bars 27, or extended bars into upper recessed channels 36 of the CMUs 35, place at least two more tendon/through bolts 29 into the through apertures in the anchor bars 27 of lower CMUs 35 |
| 8 | Repeat as needed. |

FIGS. 3A through 3D are sketches of the mechanical systems for unitized post tensioning from a Top, Side, End and Isometric perspective. The features depicted include the ducts 137 and the recess space 136. The overall strength of the demonstrated block 135 is 4000 psi or greater based on the ASTM C 140 specification. One also notes the block length BL; block width BW=approximately ½ block length BL; the block height BH=Block width BW=approximately ½ block length BL; and the distance BC13 from centerline of core 1 and core 3 and Centerlines C of anchor bar apertures.

FIGS. 4A through 4D are sketches of the bars for the mechanical systems for unitized post tensioning building systems. Shown in these sketches are an anchor bar 133, extended, relatively longer anchor bar 133A, a bar/anchor aperture pattern 180, one distance X from center point C, a second distance Y from center point C, the center point C, an anchor bar width W; and an anchor bar length L.

Figure 5C:
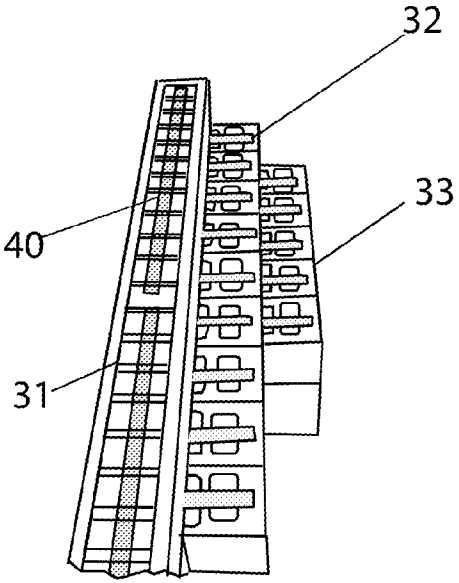
FIG. 5C is a third perspective view of the general mechanical secured block building system (MSB) wall system walls single, double, and triple.
Figure 5B:
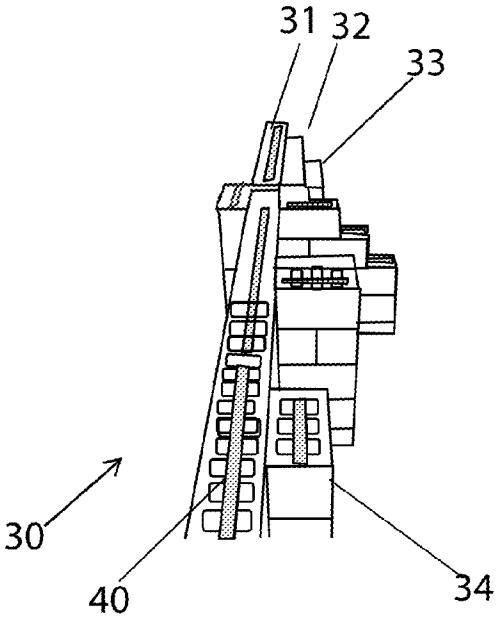
FIG. 5B is a second perspective view of the general mechanical secured block building system (MSB) wall system walls single, double, and triple.
Figure 5A:
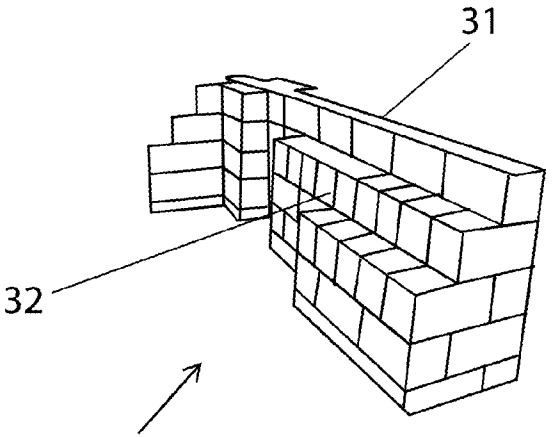
FIG. 5A is a first perspective view of the general mechanical secured block building system (MSB) wall system walls single, double, and triple.
Figure 6B:
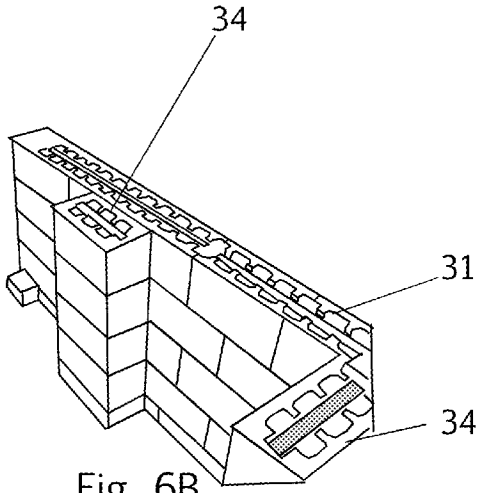
FIG. 6B is a second perspective view of additional multi walls and piers for the MSB wall system.
Figure 6D:
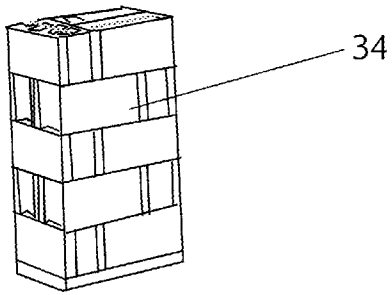
FIG. 6D is a fourth perspective view of additional multi walls and piers for the MSB wall system.
Figure 6A:
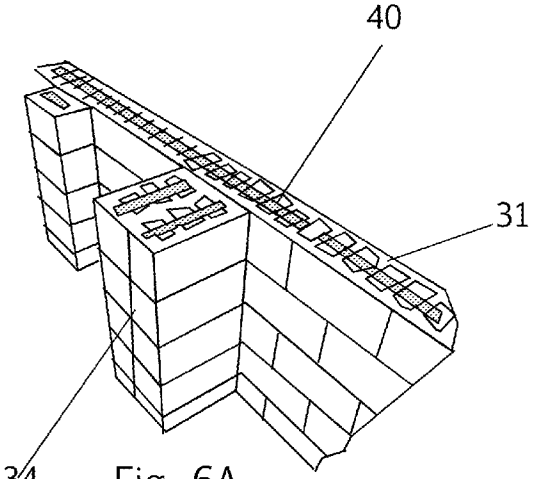
FIG. 6A is a first perspective view of additional multi walls and piers for the MSB wall system.
Figure 6C:
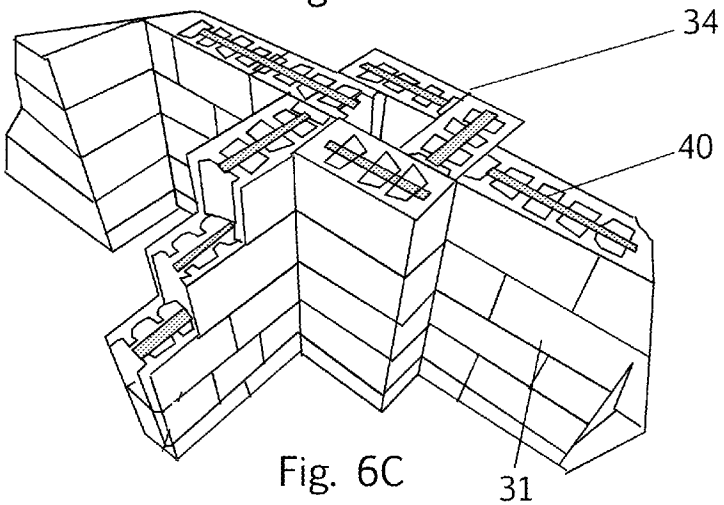
FIG. 6C is a third perspective view of additional multi walls and piers for the MSB wall system.
Figure 7A:
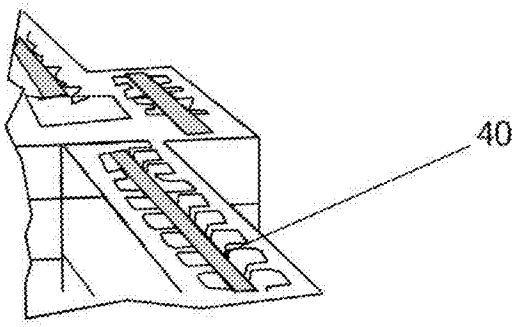
FIG. 7A is a first perspective view of MSB walls and components.
Figure 7B:
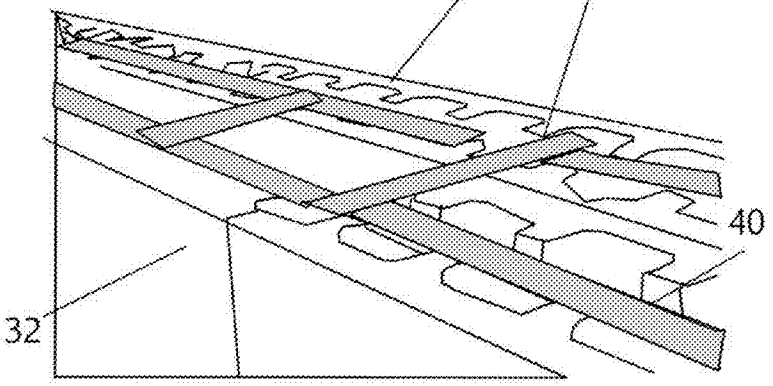
FIG. 7B is a second perspective view of MSB walls and components.
Figure 7C:
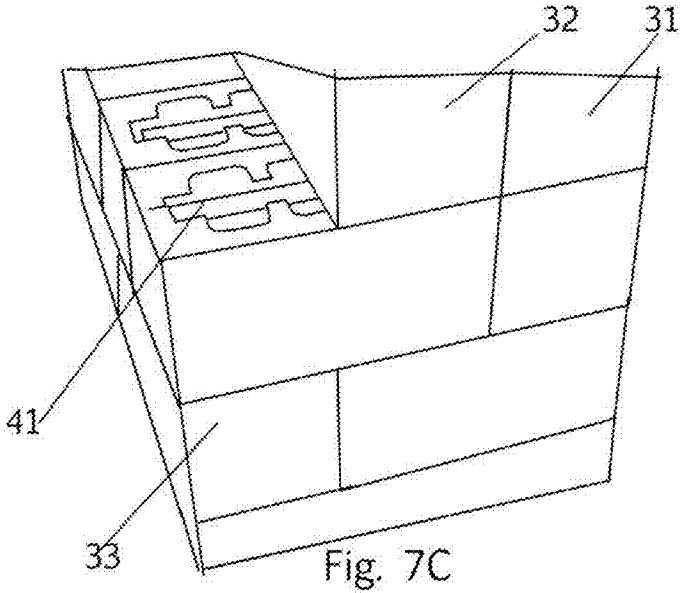
FIG. 7C is a third perspective view of MSB walls and components.
Figure 7D:
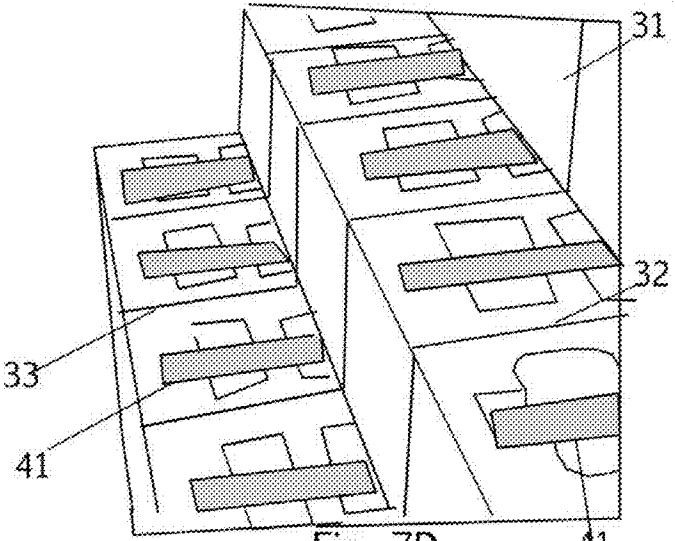
FIG. 7D is a fourth perspective view of MSB walls and components.
Figure 8A:
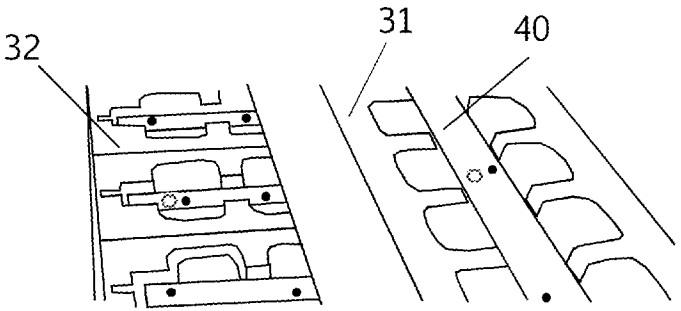
FIG. 8A is a first perspective view of the MSB walls with components and features shown from generally a side or perspective views.
Figure 8B:
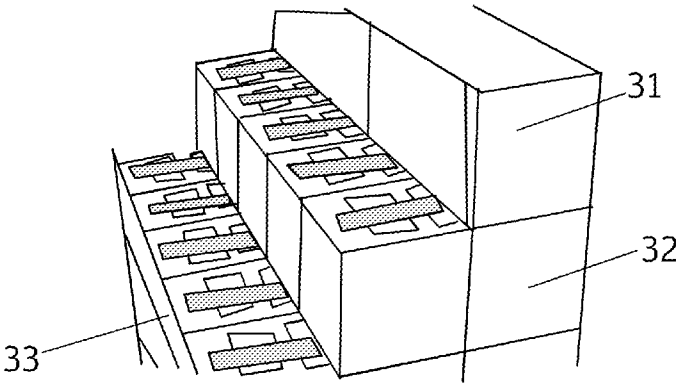
FIG. 8B is a second perspective view of the MSB walls with components and features shown from generally a side or perspective views.
Figure 8C:
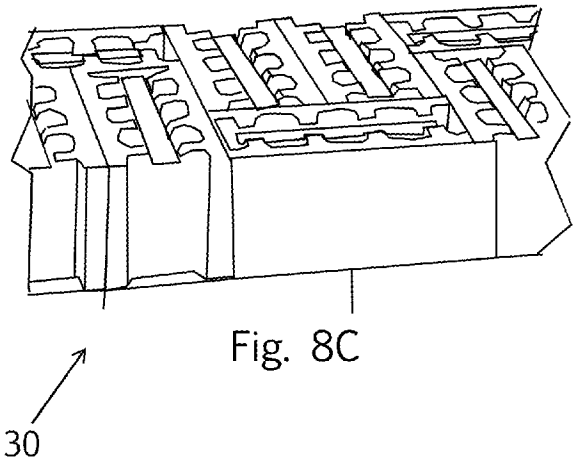
FIG. 8C is a third perspective view of the MSB walls with components and features shown from generally a side or perspective views.
Figure 8D:
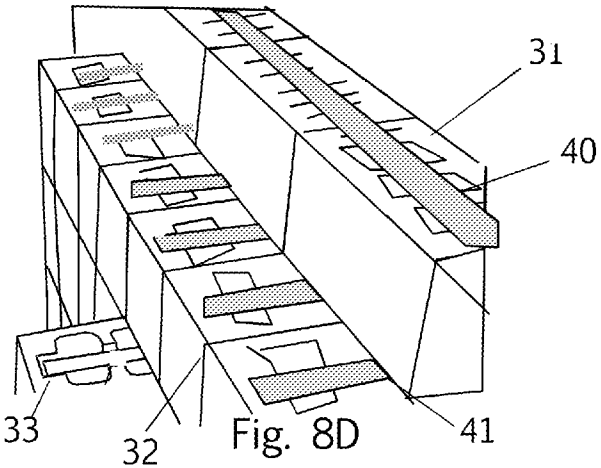
FIG. 8D is a fourth perspective view of the MSB walls with components and features shown from generally a side or perspective views.
Figure 9C:
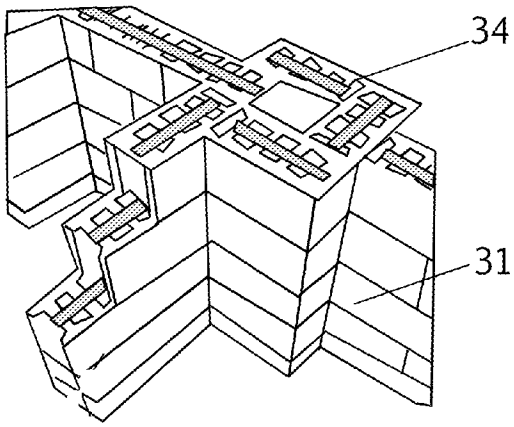
FIG. 9C is a third perspective view of the MSB walls made into various sized piers.
Figure 9B:
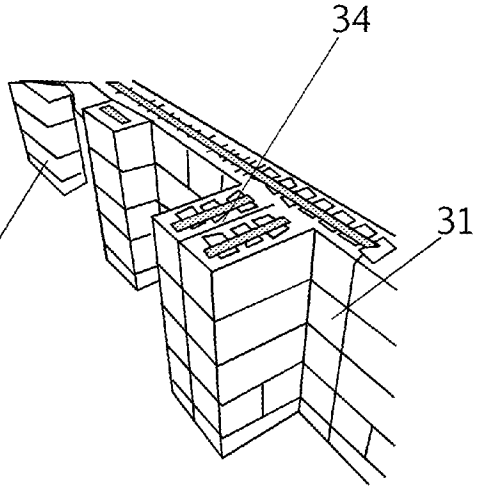
FIG. 9B is a second perspective view of the MSB walls made into various sized piers.
Figure 9A:
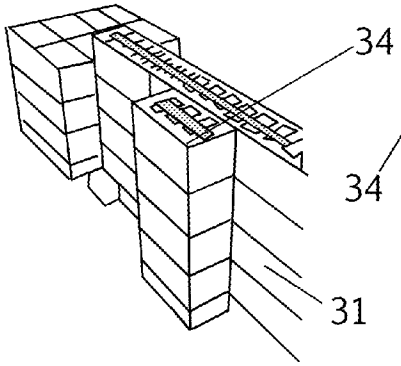
FIG. 9A is a first perspective view of the MSB walls made into various sized piers.
Figure 9E:
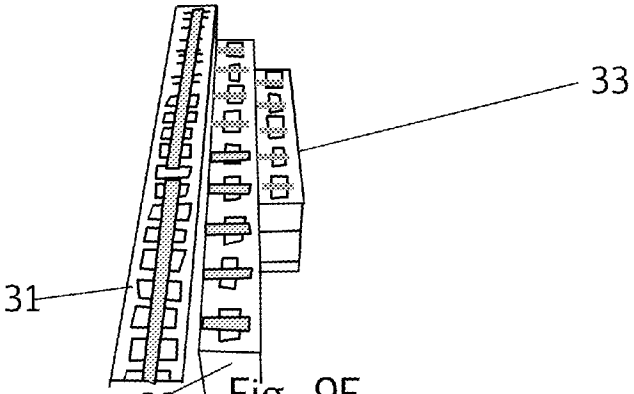
FIG. 9E is a fifth perspective view of the MSB walls made into various sized piers.
Figure 9D:
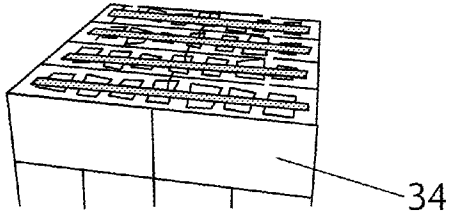
FIG. 9D is a fourth perspective view of the MSB walls made into various sized piers.

FIGS. 5A through 5C are sketches of the general MSB walls single 31, double 32, and triple 33. The multiple width walls inter-connected by perpendicularly placed courses of block 36 and/or link bars 50, shown in later FIGS. These are complemented by the normal securing bar 40 or perpendicular securing bars 41, also shown in later FIGS., at wider positions such as corners and at piers 34. One skilled in the art well appreciates there may be two, three, four or more rows. The major improved configuration utilizes a cube of designed block where the block length BL equals two times the block width BW. The cubing is complete in all three directions with the block width BW equal to the block height BH. The additional width structurally improves the strength. The interlocking perpendicularly of the courses from one contiguous wall to the next one beside it (the face of the contiguous block are touching) permits an even greater strength from the separate walls being integrally fastened to each other with interlock block and anchor bars.

FIGS. 6A through 6D are sketches of additional multi walls 31, 32, 33 and piers 34 for the mechanical secured block building system (MSB) wall system. The components shown are described above. Here are shown the manner to interconnect piers 34 with the walls in different directions as well as creating cubed piers for stand-alone uses (such as piers as building columns supporting floor decks, roof decks, structural beams and other building structures.

FIGS. 7A through 7D are more sketches of mechanical secured block building system (MSB) wall system walls and components. The components have been described. One may especially note the long bars 40, the perpendicular bars 41 and the link bars 50.

FIGS. 8A through 8D are sketches of the mechanical secured block building system (MSB) wall system with additional multi walls 31, 32, 33, components and features shown from generally a side, top and perspective views.

FIG. 9A through 9E are sketches of the MSB walls made into various sized piers. Note the cubing shows two block pier configurations in FIG. 9A; three block configuration in FIG. 9B; four block configuration in FIG. 9C with an open cavity or chase (for utilities, pipe, columns and the like); solid eight block configuration in FIG. 9D; and a three width wall in FIG. 9E.

Figure 10C:
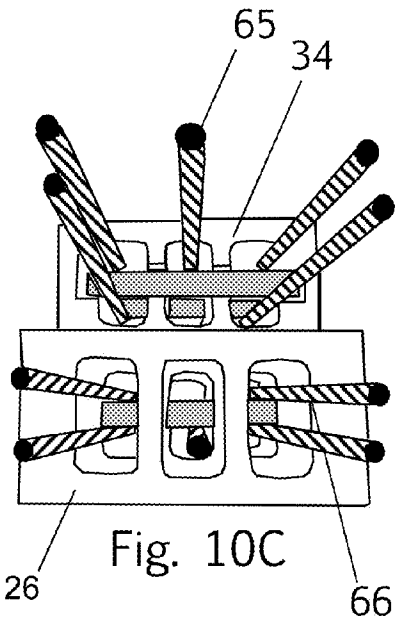
FIG. 10C is a third perspective view of the general grade beams made from MSB.
Figure 10B:
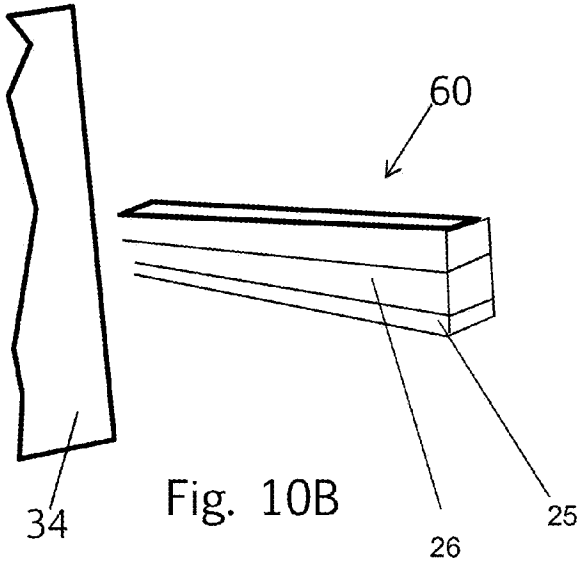
FIG. 10B is a second perspective view of the general grade beams made from MSB.
Figure 10A:
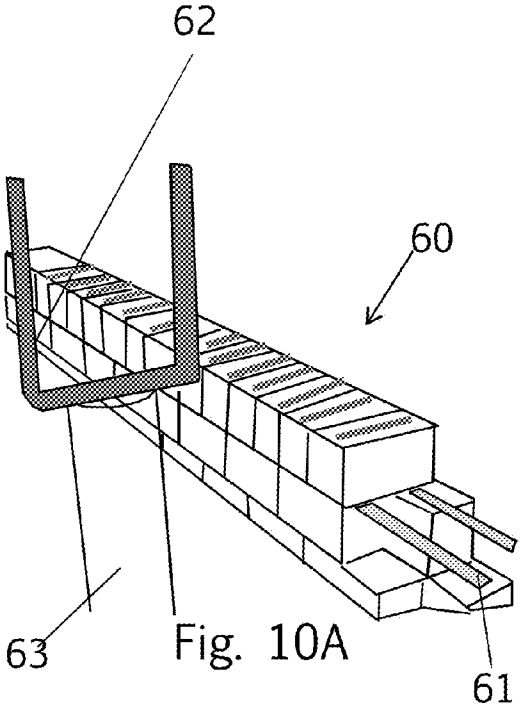
FIG. 10A is a first perspective view of the general grade beams made from MSB.
Figure 11C:
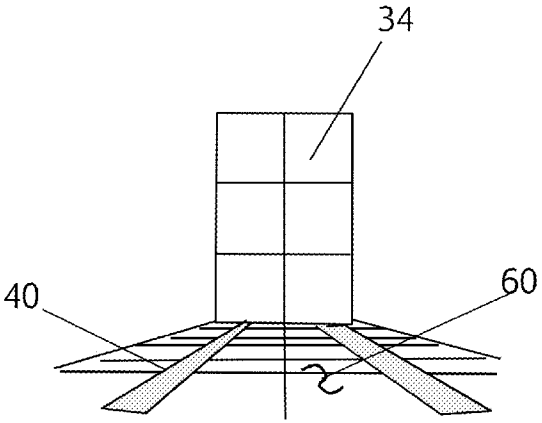
FIG. 11C is a third perspective view of grade beams made from MSB.
Figure 11E:
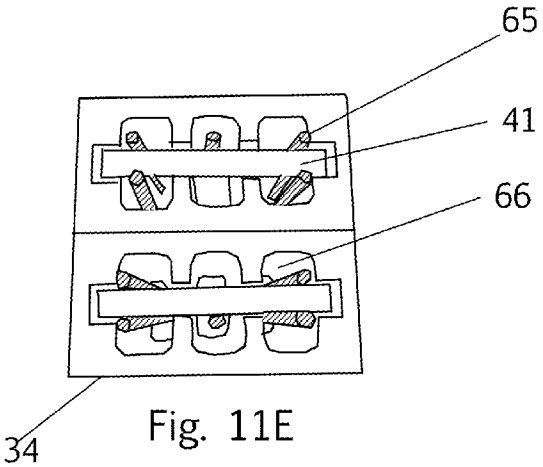
FIG. 11E is a fifth perspective view of grade beams made from MSB.
Figure 11B:
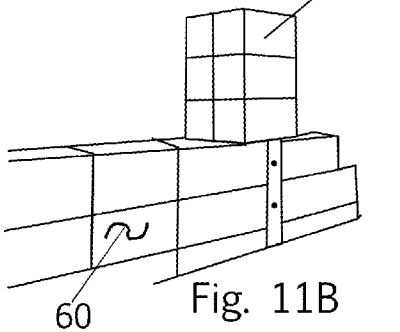
FIG. 11B is a second perspective view of grade beams made from MSB.
Figure 11D:
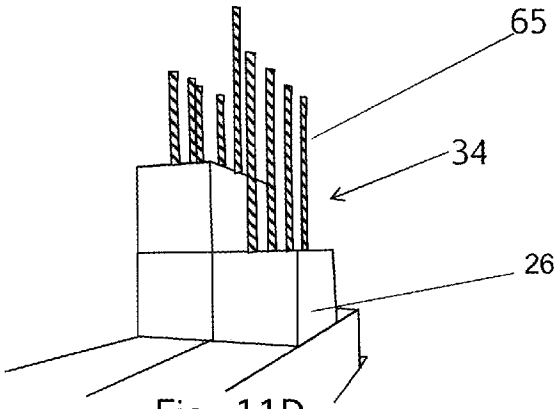
FIG. 11D is a fourth perspective view of grade beams made from MSB.
Figure 11A:
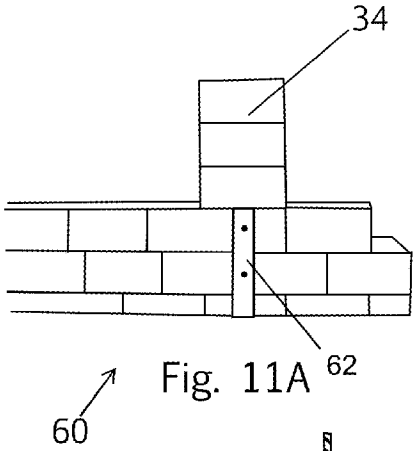
FIG. 11A is a first perspective view of grade beams made from MSB.
Figure 12A:
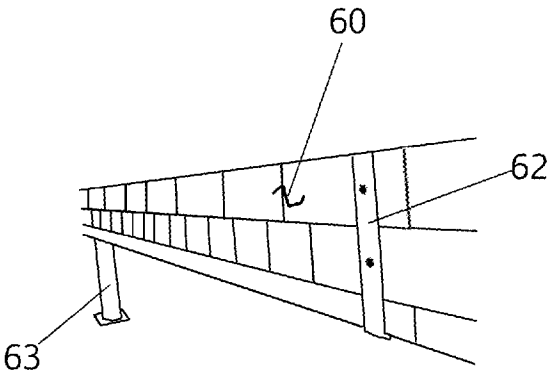
FIG. 12A is a first perspective view of the grade beams made from MSB.
Figure 12B:
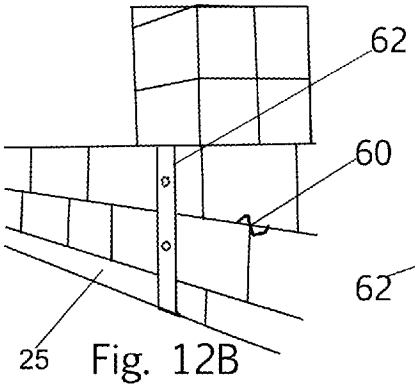
FIG. 12B is a second perspective view of the grade beams made from MSB.
Figure 12C:
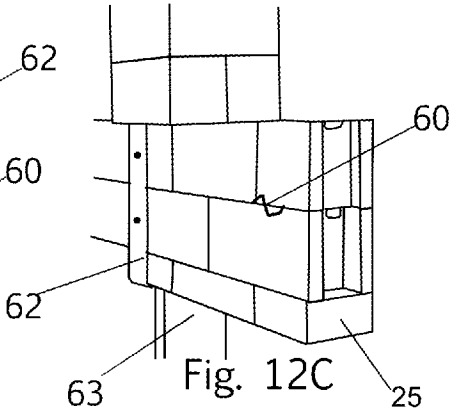
FIG. 12C is a third perspective view of the grade beams made from MSB.
Figure 12D:
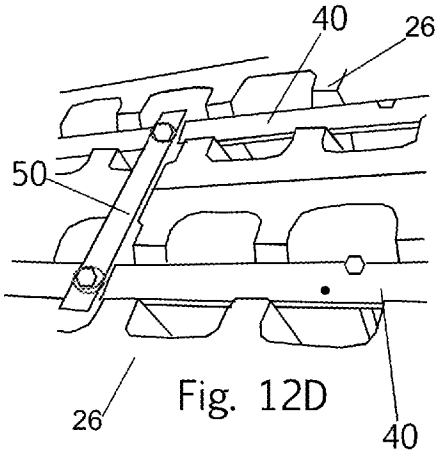
FIG. 12D is a fourth perspective view of the grade beams made from MSB.
Figure 12E:
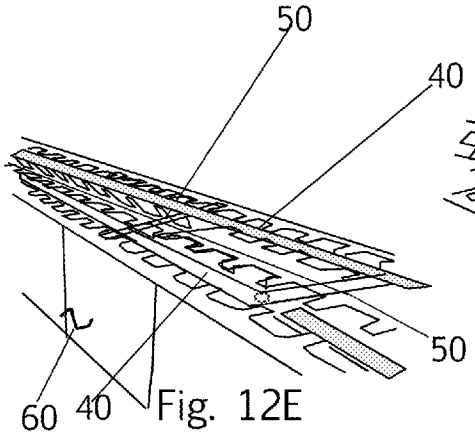
FIG. 12E is a fifth perspective view of the grade beams made from MSB.
Figure 12F:
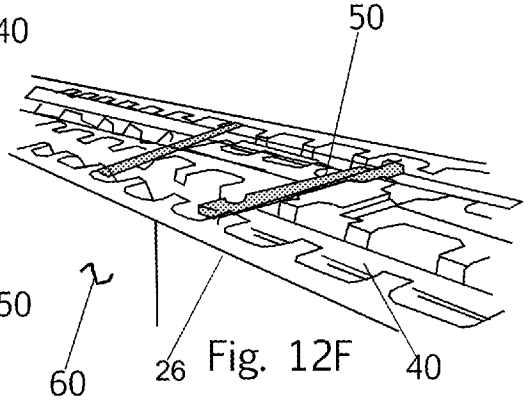
FIG. 12F is a sixth perspective view of the grade beams made from MSB.

FIG. 10A through 10C are sketches of the general grade beams 60 made from mechanical secured block building system (MSB) wall system. The multiple width grade beams 60 with potential pier 34 connections or connection to pilings/posts 63 for bridging low capacity bearing conditions such as a bog, marsh, former lake bed, etc. The grade beam 60 shown utilizes cube of designed block (length equals 2× the width and height). The beam 60 has a long, continuous tension bar 61 along the bottom of the block 26 or footer 25. One means to connect the beam 60 to the piling 63 is to use a "U-like" cradle 62 that is secured to the top of the pilings 63 and the side face of the blocks 26 of the grade beam 60. Where the beam 60 connects with posts or columns above, there can be a series of rebar tendons 65 placed in the cavity of the mechanical secured block building (MSB) columns. The rebar 65 is then grouted in place in the void 66 around the rebar 65 and in the block unit cavities. One skilled in the art of building construction appreciates the ability to vary the size of the rebar 65, the strength of the grout and the area of the column or long piers 34 to achieve the needed column strength and, importantly, the moment resistance at the beam and column junction.

FIG. 11A through 11E are sketches of grade beams 60 made from mechanical secured block building system (MSB) wall system. One can appreciate the pier 34 at the beam 60, the block 26, the voids 66 for grout, and the bars 41.

FIG. 12A through 12F are additional sketches of the grade beams made from mechanical secured block building system (MSB) wall system. The components shown have been identified and discussed above.

Figure 13A:
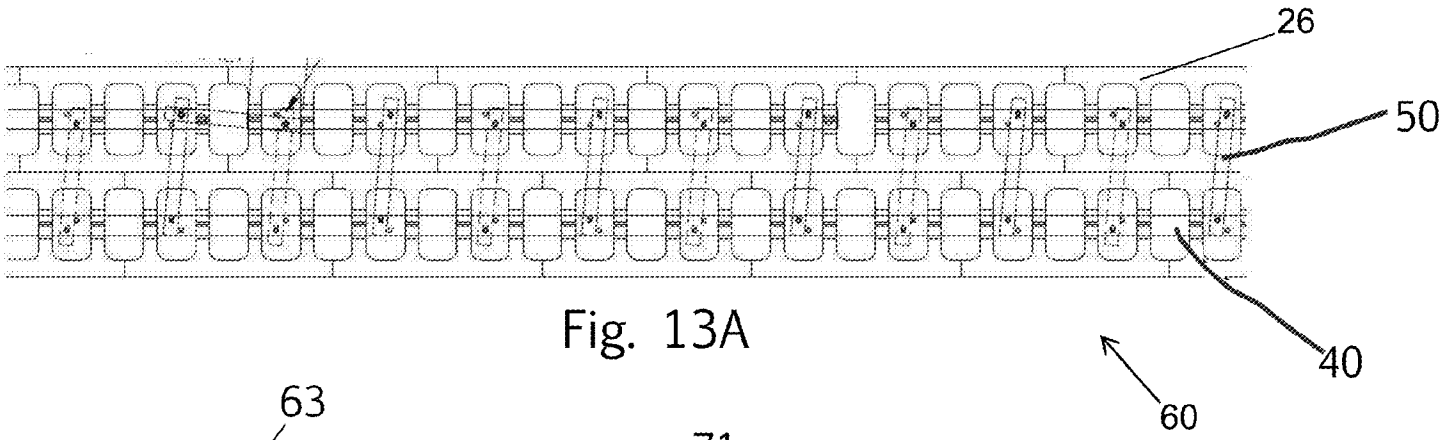
FIG. 13A is a first top plan view of a grade beam.
Figure 13B:
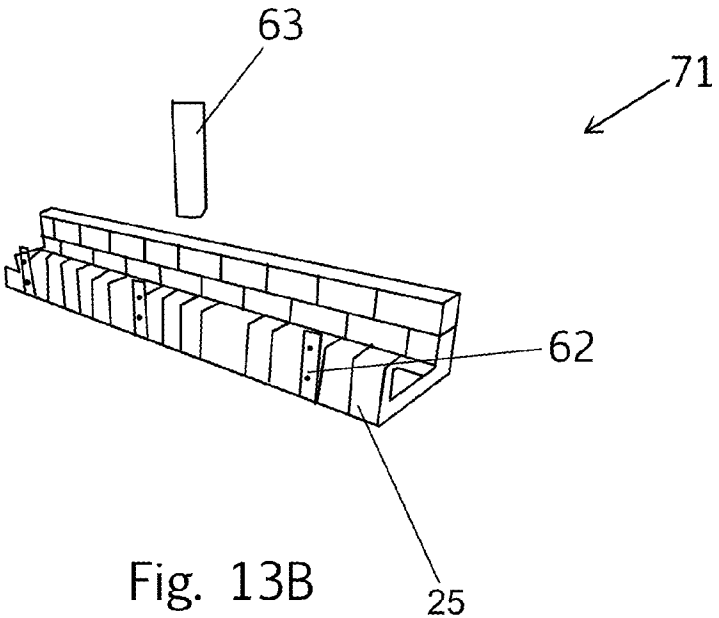
FIG. 13B is a second perspective view of a grade beam.
Figure 14A:
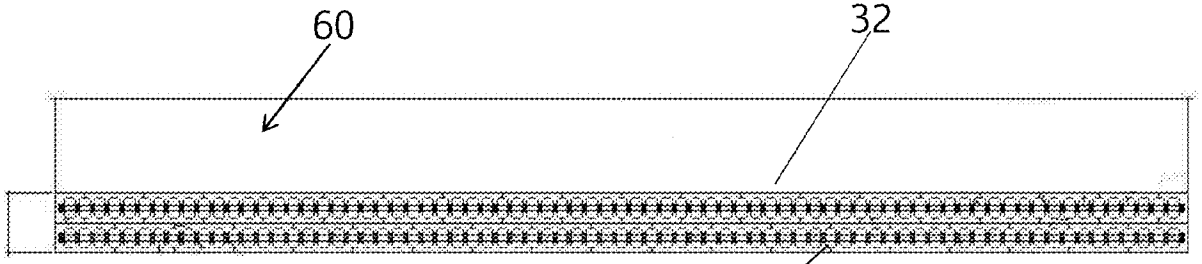
FIG. 14A is a first engineering drawing of the grade beams from MSB.
Figure 14B:
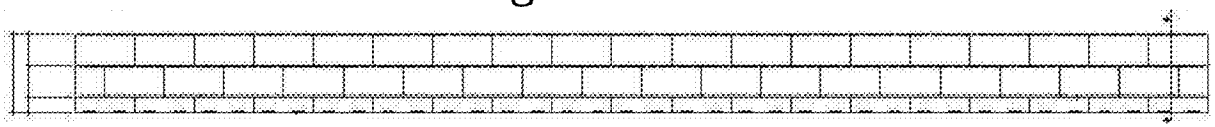
FIG. 14B is a second engineering drawing of the grade beams from MSB.
Figure 14C:
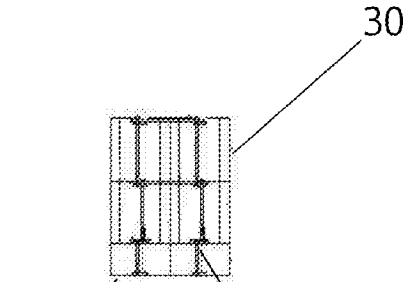
FIG. 14C is a third engineering drawing of the grade beams from MSB.
Figure 14D:
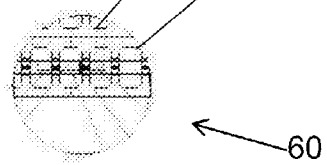
FIG. 14D is a fourth engineering drawing of the grade beams from MSB.
Figure 15B:
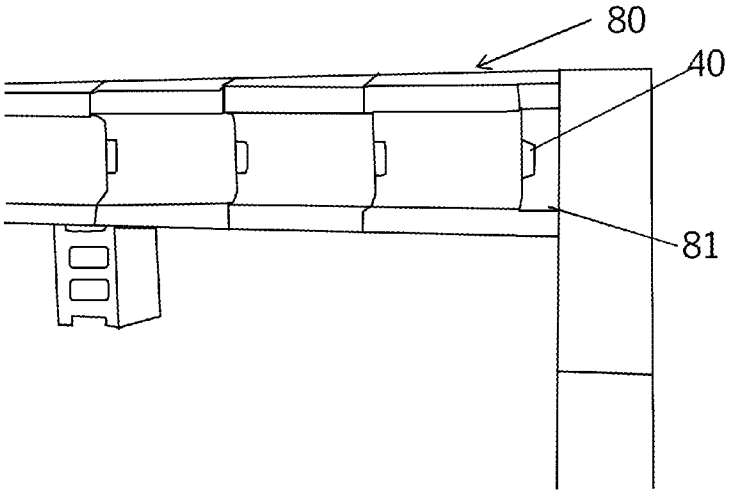
FIG. 15B is a second perspective view of horizontal Beams/Slabs of the MSB system.
Figure 15D:
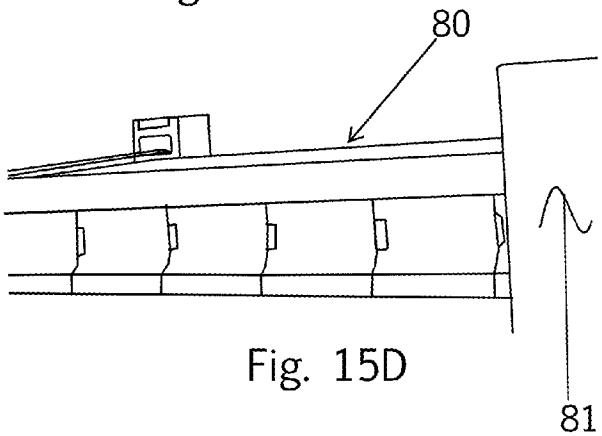
FIG. 15D is a fourth perspective view of horizontal Beams/Slabs of the MSB system.
Figure 15A:
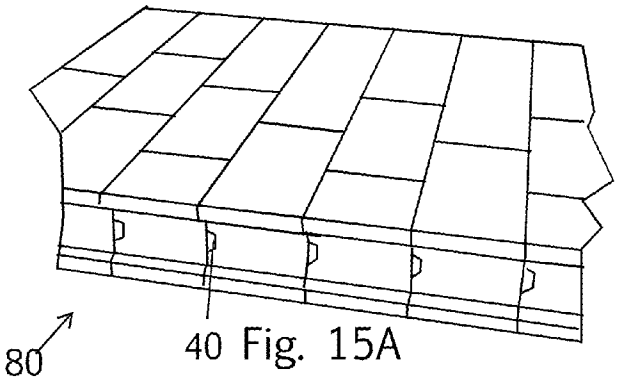
FIG. 15A is a first perspective view of horizontal Beams/Slabs of the MSB system.
Figure 15C:
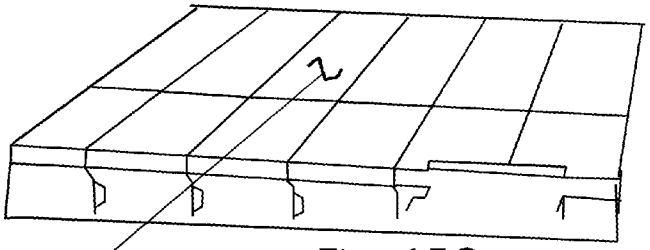
FIG. 15C is a third perspective view of horizontal Beams/Slabs of the MSB system.

FIGS. 13A and 13B are sketches of a grade beam. FIG. 13A is an engineering drawing for the grade beam 60. FIG. 13B is a sketch of a grade beam 60 used in the "Make-It-Right" rebuilding efforts in New Orleans, La., where nearly 4,000 homes in Lower 9th Ward were destroyed by Hurricane Katrina. These grade beams reduce build time as much as four (4) weeks-even more when one factors in weather conditions.

FIG. 14A through 14D are additional engineering drawings of the grade beams 60 from mechanical secured block building system (MSB) wall system with components and configurations already discussed above.

FIG. 15A through 15D and FIG. 16A through 16E are sketches of horizontal Beams/Slabs 80 of the mechanical secured block building system (MSB) wall system. The multiple width beams 80 used for floor and ceiling support on building-single and multiple story. These may be in run parallel in direction of support columns/walls or run perpendicularly. Above the beams are standard flooring or roof membranes and structures. The slabs 80 extend across beams 82 as floor or roof decks 82 or on vertical wall 81 systems or columns. To vary the strength of the slabs, the tendon and anchor bar dimensions cam be changed. The standard 5/16 diameter and thicknesses can be increased to provide additional tension capacity of the steel and concrete combination.

The details mentioned here are exemplary and not limiting. Other specific components and manners specific to describing novel technology may be added as a person having ordinary skill in the field of construction block and wall systems and devices and their uses well appreciates.

Operation

The novel technology have been described in the above embodiment. The manner of how the device operates is described below. One notes well that the description above fully illustrates the concept of the novel technology. The manner of use is well documents and shown in the drawings described above. The anchor bars 133, 133A are placed into the block recesses, and then the tendon/bolts 134 are assembled. The method shown in FIG. 2C is essentially the manner of use. The difference for the multi-walls are running courses of block perpendicular and locking with the perpendicular bars 41 into the long bars 40, 133A or utilizing link bars 80. With the grade beams 60 and horizontal decks 82, one modifies the build to accommodate the long tension bars 61, the cradle 62 and the rebar 65. Likewise for the slabs, the intersection with vertical walls 81 may require connections between the bars and tendons.

Assembly Process Description: Place two starter anchors or bar nuts 24 on the ground or foundation surface. Place CMU 35 over the starter anchor bars or starter bar nuts 24. Place two anchor bars 27 into recessed channels 36 of the CMU 35. Place two-tendon/through bolts 29 into through apertures in uppermost anchor bars 27. Tighten the two tendon/through bolts 29 into the threaded apertures in lowermost starter anchor bar nuts 24 by means of a wrench or equal. Place additional starter anchors/or bar nuts 24 next to the primary CMU 35. Place a second CMU over the additional starter anchors or bar nuts. Place one or more anchor bars 27 into recessed channels 36 of the second CMU 35.

Place two more tendon/through bolts 29 into the through apertures in the uppermost anchor bars 27 of the second CMU 35. Tighten (by means of a wrench or equal) the second set of two tendon/through bolts 29 into the threaded apertures in lowermost starter anchor bars or starter bar nuts placed under the second CMU 35. Place a third CMU 35 over the first and second CMUs 35 straddling each equally (note this is for a running bond configured wall). Place two more tendon/through bolts 29 into the through apertures in the uppermost anchor bars 27 of the third CMU 35. Tighten (by means of a wrench or equal) the third set of two tendon/through bolts 29 into the threaded apertures in the uppermost anchor bars 27 of the first and second CMU 35. Repeat process until structure is completed.

With this description it is to be understood that the novel technology is not to be limited to only the disclosed embodiment of product. The features of the novel technology are intended to cover various modifications and equivalent arrangements included within the spirit and scope of the description.

While certain novel features of this novel technology have been shown and described and are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present novel technology. Without further analysis, the foregoing will so fully reveal the gist of the present novel technology that others can, by applying current knowledge, readily adapt it for various applications without omitting features that, from the standpoint of prior art, fairly constitute essential characteristics of the generic or specific aspects of this novel technology.

Unless defined otherwise, all technical and scientific terms used herein have the same meaning as commonly understood by one of ordinary skill in the art to which these novel technologies belong. Although any methods and materials similar or equivalent to those described herein can also be used in the practice or testing of the present novel technologies, the preferred methods and materials are now described above in the foregoing paragraphs.

Other embodiments of the novel technology are possible. Although the description above contains much specificity, these should not be construed as limiting the scope of the novel technology, but as merely providing illustrations of some of the presently preferred embodiments of this novel technology. It is also contemplated that various combinations or sub-combinations of the specific features and aspects of the embodiments may be made and still fall within the scope of the novel technologies. It should be understood that various features and aspects of the disclosed embodiments can be combined with or substituted for one another in order to form varying modes of the disclosed novel technologies. Thus, it is intended that the scope of at least some of the present novel technologies herein disclosed should not be limited by the particular disclosed embodiments described above.

The terms recited in the claims should be given their ordinary and customary meaning as determined by reference to relevant entries (e.g., definition of "plane" as a carpenter's tool would not be relevant to the use of the term "plane" when used to refer to an airplane, etc.) in dictionaries (e.g., widely used general reference dictionaries and/or relevant technical dictionaries), commonly understood meanings by those in the art, etc., with the understanding that the broadest meaning imparted by any one or combination of these sources should be given to the claim terms (e.g., two or more relevant dictionary entries should be combined to provide the broadest meaning of the combination of entries, etc.) subject only to the following exceptions: (a) if a term is used herein in a manner more expansive than its ordinary and customary meaning, the term should be given its ordinary and customary meaning plus the additional expansive meaning, or (b) if a term has been explicitly defined to have a different meaning by reciting the term followed by the phrase "as used herein shall mean" or similar language (e.g., "herein this term means," "as defined herein," "for the purposes of this disclosure [the term] shall mean," etc.). References to specific examples, use of "i.e.," use of the word "novel technology," etc., are not meant to invoke exception (b) or otherwise restrict the scope of the recited claim terms. Other than situations where exception (b) applies, nothing contained herein should be considered a disclaimer or disavowal of claim scope. Accordingly, the subject matter recited in the claims is not coextensive with and should not be interpreted to be coextensive with any particular embodiment, feature, or combination of features shown herein. This is true even if only a single embodiment of the particular feature or combination of features is illustrated and described herein. Thus, the appended claims should be read to be given their broadest interpretation in view of the prior art and the ordinary meaning of the claim terms.

Unless otherwise indicated, all numbers or expressions, such as those expressing dimensions, physical characteristics, etc. used in the specification (other than the claims) are understood as modified in all instances by the term "approximately." At the very least, and not as an attempt to limit the application of the doctrine of equivalents to the claims, each numerical parameter recited in the specification or claims which is modified by the term "approximately" should at least be construed in light of the number of recited significant digits and by applying ordinary rounding techniques.

While the novel technology has been illustrated and described in detail in the drawings and foregoing description, the same is to be considered as illustrative and not restrictive in character. It is understood that the embodiments have been shown and described in the foregoing specification in satisfaction of the best mode and enablement requirements. It is understood that one of ordinary skill in the art could readily make a nigh-infinite number of insubstantial changes and modifications to the above-described embodiments and that it would be impractical to attempt to describe all such embodiment variations in the present specification. Accordingly, it is understood that all changes and modifications that come within the spirit of the novel technology are desired to be protected.

What is claimed is:

1. A method for constructing a structure from a mechanical secured block building system with concrete masonry units, comprising;

a) placing first and second anchor bars on a foundation surface;

b) placing a first concrete masonry unit over the first and second anchor bars;

c) placing a third anchor bar into an anchor bar channel in the first concrete masonry unit;

d) placing first and second tendon through bolts into first and second through apertures in the third anchor bar;

e) threadably engaging the first and second tendon through bolts with first and second threaded apertures in the first and second anchor bars;

f) placing a fourth anchor bar on the foundation surface adjacent the first anchor bar;

g) placing a second concrete masonry unit over the first and fourth anchor bars;

h) placing a fifth anchor bar into anchor bar channel in the second concrete masonry unit;

i) placing third and fourth tendon through bolts into third and fourth through apertures in the fifth anchor bar;

j) threadably engaging the third and fourth tendon through bolts with third and fourth threaded apertures in the first and fourth anchor bars;

k) positioning a third concrete masonry unit over the first and second concrete masonry units wherein the third concrete masonry unit straddles the first and second concrete masonry units;

l) placing a sixth anchor bar into an anchor bar channel of the third concrete masonry unit;

m) placing fifth and sixth tendon through bolts into fifth and sixth through apertures in the sixth anchor bar; and n) threadably engaging the fifth and sixth tendon through bolts with fifth and sixth threaded apertures in the third and fifth anchor bars;

wherein each of the concrete masonry units further comprises: a masonry longitudinal length, a masonry width measured perpendicularly to the masonry longitudinal length, wherein the masonry width which is one half the longitudinal length and is substantially uniform along the masonry longitudinal length, a masonry top surface, the masonry top surface being substantially planar, a masonry bottom surface, the masonry bottom surface being substantially planar, a masonry height which is one half the longitudinal length and which is measured between the masonry top and masonry bottom surfaces, the masonry height being substantially uniform along the masonry longitudinal length, a first through-cavity formed through the masonry unit from the top surface of the bottom surface, a second through-cavity formed through the masonry unit from the top surface to the bottom surface, a third through-cavity formed through the masonry unit from the top surface to the bottom surface, and an anchor bar channel formed in the masonry top surface and oriented substantially along the masonry longitudinal length;

wherein each of the anchor bars further comprises: (i) a first set of apertures, the first set of apertures comprising a first non-threaded aperture and a first threaded aperture, wherein the first non-threaded aperture and the first threaded aperture are located in first and second diagonally opposing quadrants of a coordinate system defined by a longitudinal centerline of the anchor bar and a line that is perpendicular to the longitudinal centerline; and (ii) a second set of apertures neighboring the first set of apertures, the second set of apertures comprising a second non-threaded aperture that is substantially the same as the first non-threaded aperture, and a second threaded aperture that is substantially the same as the first threaded aperture, wherein the second non-threaded aperture and the second threaded aperture are located in third and fourth diagonally opposing quadrants of the coordinate system but spaced longitudinally from the first set of apertures, wherein the first set of apertures is aligned with the first through-cavity and the second set of apertures is aligned with the third through-cavity when the anchor bar is placed into the anchor bar channel of the masonry unit; and wherein a width of the anchor bar is smaller than a width of the anchor bar recess channel of the masonry unit; and wherein each tendon through bolt further comprises: (i) a first fastener end and a second fastener end, (ii) a head portion at the first fastener end, (iii) a stem portion rigidly affixed to the head portion, the stem portion comprising a threaded portion at the second fastener end; wherein the head portion does not fit through the first non-threaded aperture; wherein the stem portion slides freely through the first non-threaded aperture; and wherein the threaded portion is configured to threadably engage the first threaded aperture.

2. The method of claim 1 and further comprising:

o) repeating the above steps until a desired structure is completed.

3. A method for building a mechanical secured block structure, comprising:

a) placing a first footer block on a desired surface;

b) inserting two starter bar nuts into the first footer block;

c) inverting the first footer block;

d) placing a first concrete masonry unit at least partially over the first footer block;

e) placing second and third footer blocks, each including two starter bar nuts adjacent the first footer block;

f) placing a second concrete masonry unit adjacent the first concrete masonry unit;

g) positioning each of the first and second concrete masonry units to equally straddle two adjacent footer blocks of the first, second, and third footer blocks;

h) positioning at least one anchor bar into anchor bar channels of the first and second concrete masonry units; and i) bolting the first and second concrete masonry units to the first, second, and third footer blocks to interconnect the first and second concrete masonry units and the first, second, and third footer blocks to define a contiguous wall;

wherein each of the first and second concrete masonry units and each of the first, second, and third footer blocks are post tensioned to be under compression.

4. A method for constructing a structure from a mechanical secured block building system with concrete masonry units, comprising;

positioning a first concrete masonry unit adjacent a second concrete masonry unit such that the first and second concrete masonry units are aligned along a longitudinal axis;

placing one or more anchor bars into anchor bar channels of the first and second concrete masonry units;

placing a third concrete masonry unit over the first and second concrete masonry units such that the third concrete masonry unit straddles the first and second concrete masonry units;

placing an additional anchor bar into an anchor bar channel of the third concrete masonry unit;

placing first and second tendon through bolts into first and second through apertures of the additional anchor bar; and threadably engaging the first and second tendon through bolts with first and second threaded apertures in the one or more anchor bars in the anchor bar channels of the first and second concrete masonry units.

5. The method of claim 4, wherein the one or more anchor bars in the anchor bar channels of the first and second concrete masonry units include a long bar extending about a length corresponding to combined longitudinal lengths of the first and second concrete masonry units.

6. The method of claim 4, further including:

placing a plurality of anchor bars or a plurality of footer blocks on a foundation surface;

placing the first and second concrete masonry units on the plurality of anchor bars or the plurality of footer blocks; and fastening the first and second concrete masonry units to the plurality of anchor bars or the plurality of footer blocks.

7. The method of claim 6, further including:

placing first and second footer blocks on the foundation surface;

inserting two starter bar nuts into each of the first and second footer blocks;

inverting the first and second footer blocks; and placing the first and second concrete masonry units on the first and second footer.

8. The method of claim 6, further including:

placing tendon through bolts into apertures of the one or more anchor bars of the first and second concrete masonry units; and threadably engaging the tendon through bolts with the starter bar nuts of the first and second footer blocks.

9. The method of claim 6, further including:

placing first and second anchor bars on the foundation; and placing the first and second concrete masonry units of the first and second anchor bars.

10. The method of claim 9, further including:

placing tendon through bolts into apertures of the one or more anchor bars of the first and second concrete masonry units; and threadably engaging the tendon through bolts with threaded apertures of the first and second anchor bars.

11. The method of claim 4, wherein each respective concrete masonry units further comprises: a masonry longitudinal length, a masonry width measured perpendicularly to the masonry longitudinal length, wherein the masonry width which is essentially one half the longitudinal length and which is substantially uniform along the masonry longitudinal length, a masonry top surface, the masonry top surface being substantially planar, a masonry bottom surface, the masonry bottom surface being substantially planar, a masonry height which is essentially one half the longitudinal length and which is measured between the masonry top and masonry bottom surfaces, the masonry height being substantially uniform along the masonry longitudinal length, a first through-cavity formed through the masonry unit from the top surface of the bottom surface, a second through-cavity formed through the masonry unit from the top surface to the bottom surface, a third through-cavity formed through the masonry unit from the top surface to the bottom surface, and an anchor bar channel formed in the masonry top surface and oriented substantially along the masonry longitudinal length.

12. The method of claim 4, wherein each respective anchor bar further comprises: (i) a first set of apertures, the first set of apertures comprising a first non-threaded aperture and a first threaded aperture, wherein the first non-threaded aperture and the first threaded aperture are located in first and second diagonally opposing quadrants of a coordinate system defined by a longitudinal centerline of the anchor bar and a line that is perpendicular to the longitudinal centerline; and (ii) a second set of apertures neighboring the first set of apertures, the second set of apertures comprising a second non-threaded aperture that is substantially the same as the first non-threaded aperture, and a second threaded aperture that is substantially the same as the first threaded aperture, wherein the second non-threaded aperture and the second threaded aperture are located in third and fourth diagonally opposing quadrants of the coordinate system but spaced longitudinally from the first set of apertures, wherein the first set of apertures is aligned with the first through-cavity and the second set of apertures is aligned with the third through-cavity when the anchor bar is placed into the anchor bar channel of the masonry unit; and wherein a width of the anchor bar is smaller than a width of the anchor bar channel of the masonry unit.

13. The method of claim 4, wherein each respective through tendon further comprises: (i) a first fastener end and a second fastener end, (ii) a head portion at the first fastener end, (iii) a stem portion rigidly affixed to the head portion, the stem portion comprising a threaded portion at the second fastener end; wherein the head portion does not fit through the first non-threaded aperture; wherein the stem portion slides freely through the first non-threaded aperture; and wherein the threaded portion is configured to threadably engage the first threaded aperture.

* * * * *